US005243892A

United States Patent [19]

Jindra

[11] Patent Number: 5,243,892

[45] Date of Patent: Sep. 14, 1993

[54] PORTABLE SAW MILL FRAME

[75] Inventor: Josef Jindra, Tegnaby 93, 36044 Ingelstad, Sweden

[73] Assignees: George Bosak; George Sigmund; Josef Jindra, all of Kitchner, Canada

[21] Appl. No.: 856,712

[22] Filed: Mar. 24, 1992

[51] Int. Cl.[5] ..... B27B 17/00

[52] U.S. Cl. ..... 83/797; 83/452; 83/574

[58] Field of Search ..... 83/743, 574, 794, 797, 83/788, 452, 451; 144/376, 378

[56] References Cited

U.S. PATENT DOCUMENTS

| | | | |
|---|---|---|---|
| 951,937 | 3/1910 | Bryan | 83/794 |
| 3,926,086 | 12/1975 | Crane | 83/794 X |
| 4,235,140 | 11/1980 | Reece | 83/574 X |
| 4,275,632 | 6/1981 | Ross | 83/794 |
| 4,640,170 | 2/1987 | Bakken | 83/574 X |
| 4,660,454 | 4/1987 | Elsey | 83/574 X |
| 5,035,166 | 7/1991 | Carlson et al. | 144/378 X |
| 5,046,391 | 9/1991 | Lewis | 144/378 X |

*Primary Examiner*—Frank T. Yost
*Assistant Examiner*—Rinaldi Rada
*Attorney, Agent, or Firm*—Robert M. Phipps

[57] ABSTRACT

A portable saw mill frame is disclosed which has a frame base of a generally rectangular, elongated configuration. It is comprised of preferably three subsections bolted to each other and easily disconnected. An inverted U-shaped frame is supported by a carriage rolling along side tracks defined by the frame base. It has a cross-beam supporting a transversely slidable holder for a chain saw. The device is substantially sturdier than prior art portable saw mill frames.

4 Claims, 4 Drawing Sheets

PORTABLE SAW MILL FRAME

BACKGROUND AND SUMMARY OF THE INVENTION

This invention relates to the improvement in the sawing of timber, and in particular to a portable saw mill frame facilitating the sawing of logs into lumber products at the location of the felled trees thereby eliminating the necessity to transport the harvested logs to a conventional saw mill for a processing.

Various problems have been encountered with prior portable mill frames. Portable mills are, in general, of a fixed length and are not adjustable to the exact length of the sawed timber, particularly if the timber is of an extraordinary length. They also lack sufficient support for cutting and log holding elements.

Canadian Patent 904,723 (Pluckhahn) discloses a portable sawmill including a longitudinal beam along which a transverse holder of a chain saw support is cantilevered, with the chain saw fixed at a free end of the transverse holder. The device must have insufficient stability. Canadian Patent 1,133,800 (Reece) shows a somewhat similar arrangement having the same drawback of a relatively low stability due to the mounting of the chain saw at a free end of a transverse holder. Canadian Patent 1,037,835 (Paquette) present a rigid rectangular frame with the saw holding device guided along top rails spaced a substantial distance above the ground. The device must either be placed over a log or a log must be inserted endwise into the frame. In any case, the improved rigidity of the frame (over the first two prior art references) is offset by inconvenience of operation.

It is an object of the invention to provide a portable saw mill which is easily transported to the actual sawing location and is easily assembled, operated and dismantled. Another object is to provide a portable saw mill, in which the log holding frame base and tracks for the saw carriage provide an improved stability for the sawing element, an unhindered and smooth movement of a saw carriage, and an easy log loading onto the frame base.

A still another object of the invention is to provide a portable saw mill in which the saw carriage is stabilized to eliminate vibration of the saw causing uneven cuts and producing unwanted and dangerous torque movements of the saw, of the log holding clamps and of the saw carriage.

A yet another object is to provide a portable saw mill frame in which a saw can be mounted on the carriage cross-beam for adjustment for selected thickness of a series of cuts so that logs are then sawed into exact sized lumber products of a high professional quality.

Another object of the invention is to provide a portable saw mill frame in which cutting length can be easily extended to the length required for sawing of an especially long log.

In general terms, the invention provides a portable sawmill frame comprising, in combination:

(a) a frame base having two opposed ends and two opposed sides;

(b) said sides defining two opposed tracks, each track being generally coincident with a top portion of a side beam, each side beam comprising an underside adapted to be placed on the ground when the frame is in an assembled state;

(c) a carriage including rollers adapted to roll on said tracks to allow a rolling movement of the carriage along the tracks;

(d) two uprights fixedly secured to said carriage;

(e) a cross-beam secured to the uprights near upper ends thereof and extending transversely of the carriage, whereby the cross-beam and the uprights define a rectangular structure having the general shape of an inverted "U";

(f) a chain saw holding device slidable along said cross-beam and including displacement device for selectively displacing the a respective chain saw to a desired location transversely of the carriage; and (g) said frame base including mounting device for fixedly securing log clamping devices to the frame.

BRIEF DESCRIPTION OF THE DRAWINGS

The invention will be described by way of a preferred embodiment with reference to the accompanying simplified, diagrammatic drawings. In the drawings.

DETAILED DESCRIPTION OF THE PREFERRED EMBODIMENT

Figure 4:
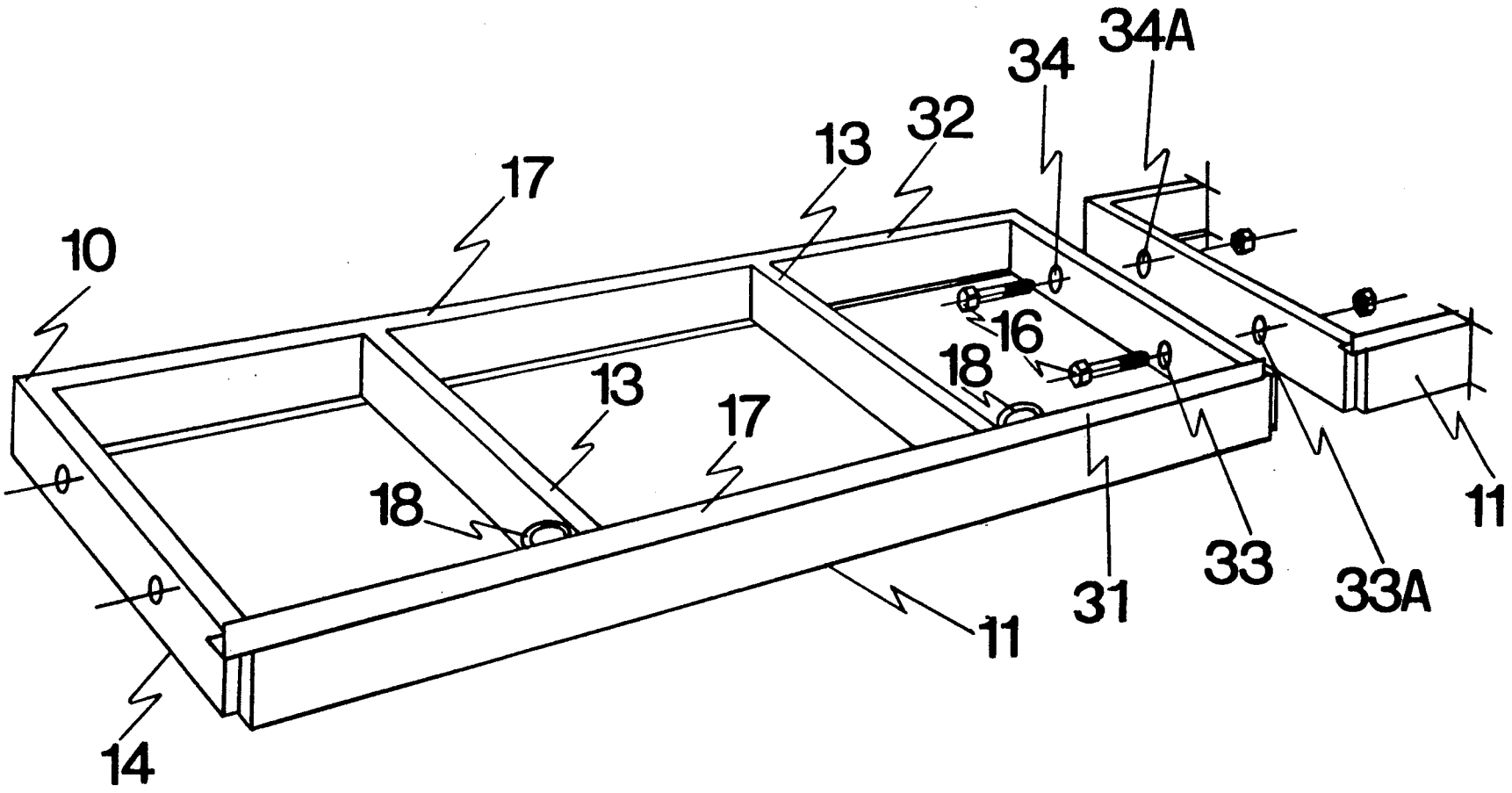
FIG. 4 is a diagrammatic perspective view of one section of the frame of the device of the invention.

The portable saw mill of the present invention shown in the drawings includes a log holding frame base 10. The frame base 10 is composed of three subframes 11 each of a generally identical configuration, which is best shown in FIG. 4.

Each subframe 11 comprises two longitudinal or side beams 31, 32 a pair of end beams, one at each end of the subframe and a pair of spacers or struts 13 disposed between and parallel with the end beams. Each end beam 14 is provided, near each longitudinal beam 31, 32 with bolt passages 33, 34 which are complementary with the bolt passages 33A 34A at the opposite end of the subframe 11. Accordingly, two or more subframes 11 can be rigidly connected to each other by bolts 16 to form the elongated log holding frame.

In the embodiment shown, the subframes are each of a size of about 2 meters in length and about 60 cm wide. The height of the beams 31, 32 forming the subframe 11 is only about 5 cm, to facilitate the rolling of a log onto the frame. The size of the subframe 11 makes the subframe the bulkiest part of the entire mill. Yet, it is easily carried by hand and transported e.g. in a station-wagon.

Figure 1:
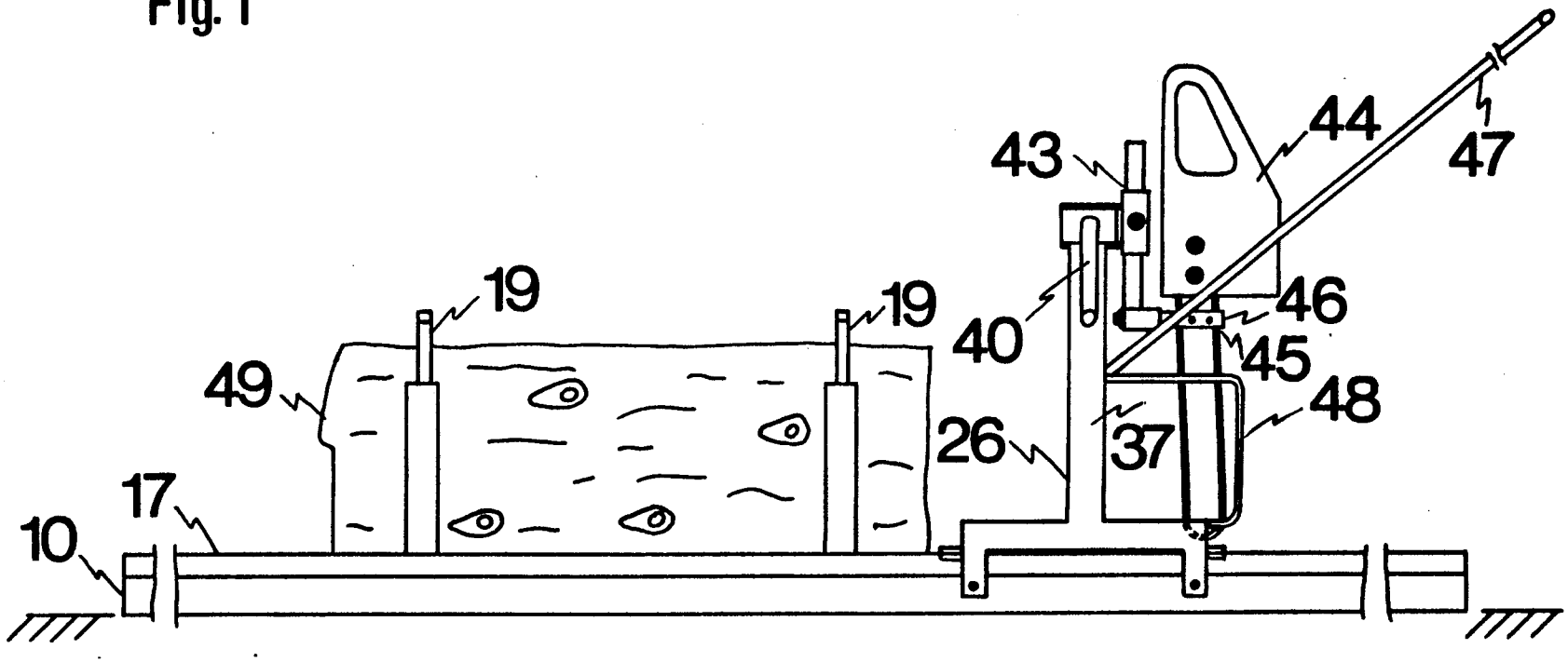
FIG. 1 is a diagram of a side view of the preferred embodiment of the device of the invention.

The embodiment shown has a frame composed of a total of three subframes 11. When assembled, as diagrammatically shown in FIG. 1, they define a pair of longitudinal tracks 17 formed by the side beams, with the spacing as set forth. The subframes and thus the frame are placed directly on the ground, without any legs or other supports, to make the frame as low as possible for reasons mentioned above.

At the corners between one longitudinal beam 31, 32 and each of the struts 13, a vertical sleeve 18 is welded. It defines an upright passage complementary with a tubular housing of a log clamp which will be described later. A fixing bolt 21 serves the purpose of rigidly securing the housing of the clamp 19 to the sleeve and thus to the frame base 10.

Figure 2:
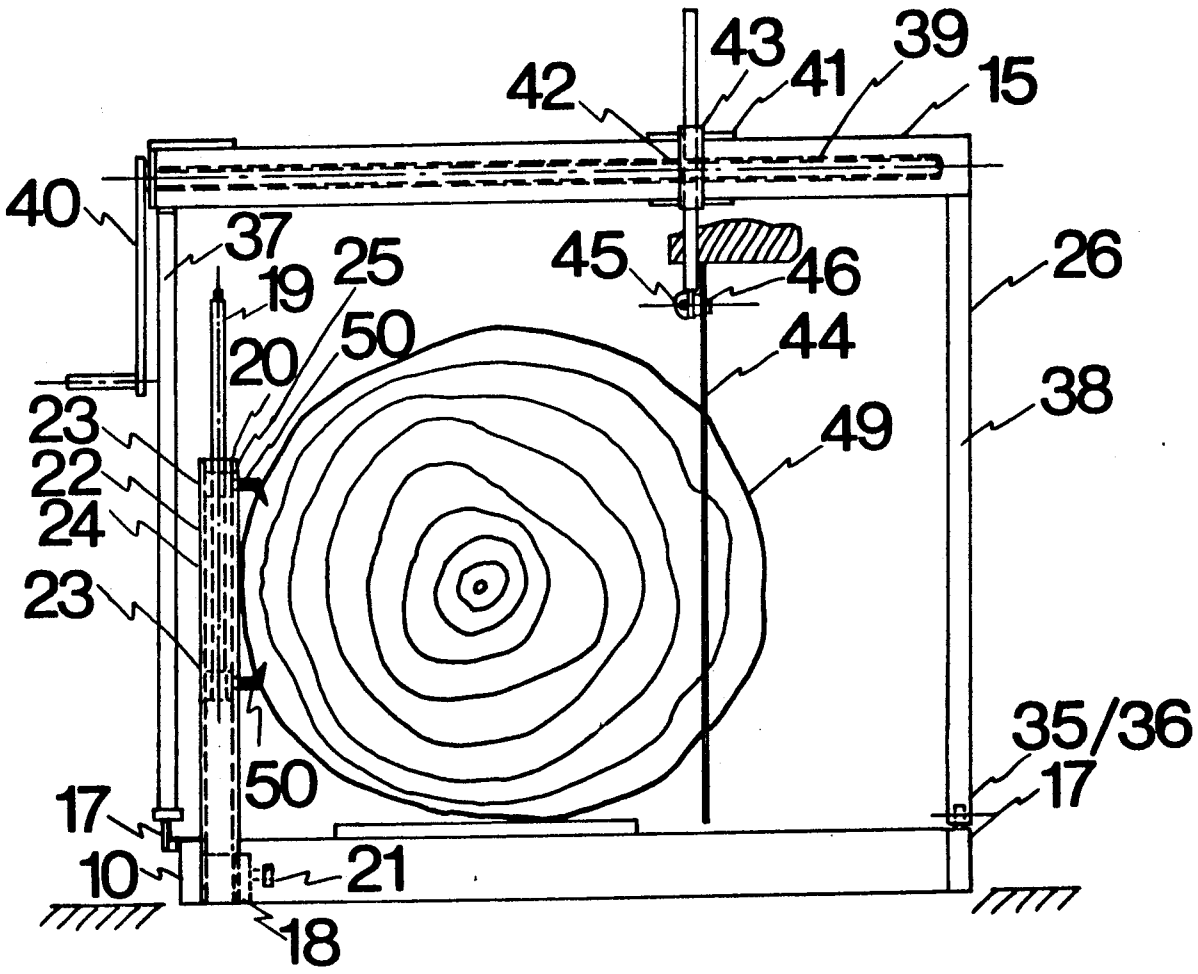
FIG. 2 is an end view thereof.

The clamp 19 is comprised of a tubular body 20. In an assembled state, the tubular body is firmly held in the sleeve 18, as indicated in FIG. 2. Within the tubular body 20 is rotatable a leading screw 22. Threaded on the screw 22 is a pair of threaded blocks 23, each provided with a clamping hook projecting through a longitudinal slot 24 in the side wall of the tubular housing 25. The screw 22, of course, has two thread runs, one for each of the blocks 23, the threads having an opposite pitch as is well known in the art of clamping devices. Accordingly, the turning of the screw in one direction causes the blocks to slide toward each other and, in the opposite direction, away from each other, along the tubular body 20.

Figure 3:
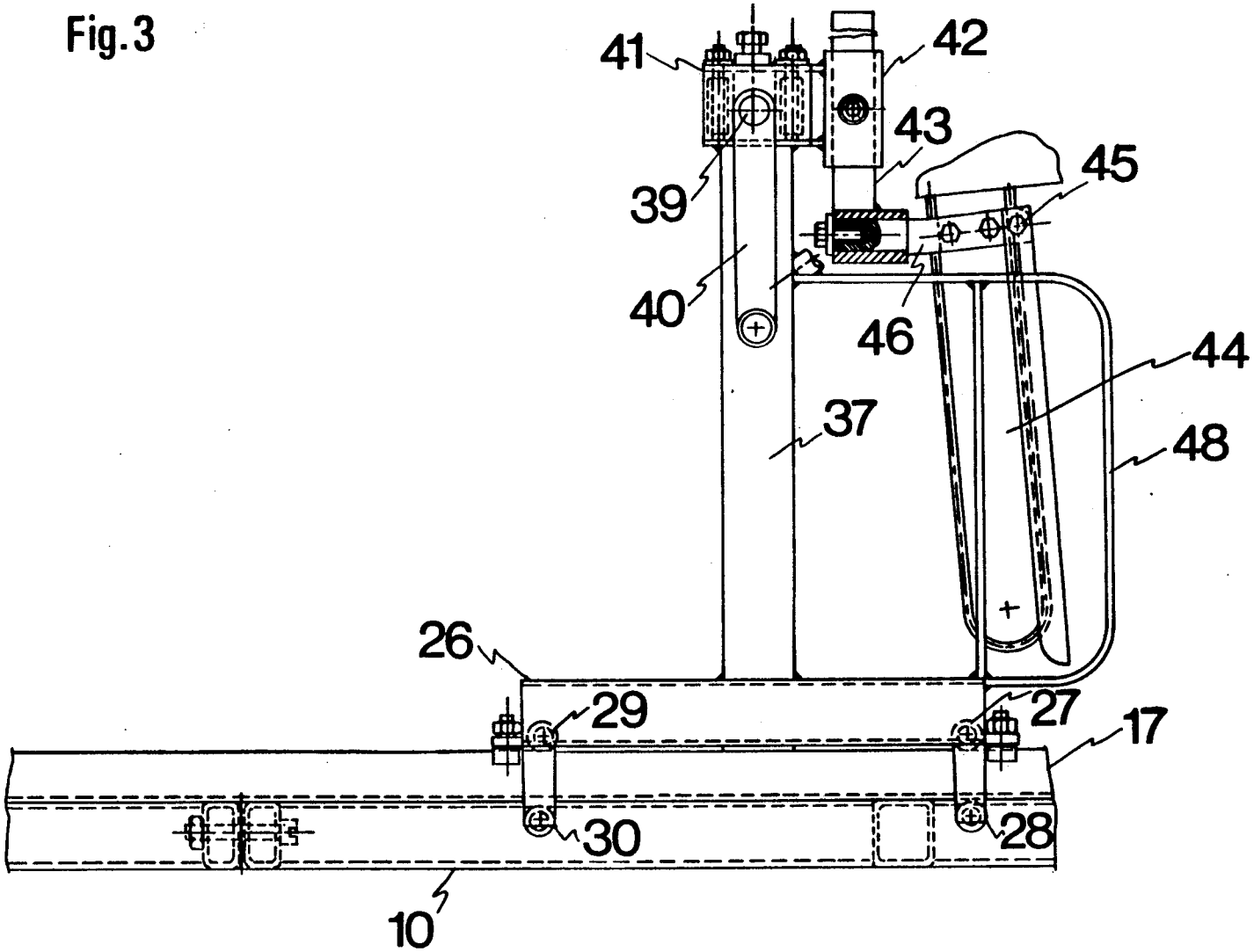
FIG. 3 is a view similar to that of FIG. 1 but showing the device in a greater detail.

A saw carriage 26 is arranged on the tracks 17 for free rolling along the frame base 10. The particular way of securing the rolling of the carriage 26 along the frame can be achieved in many different ways, there being no particular preference to any arrangement. It will suffice to say that the guiding along the frame must secure that the carriage is not only guided sideways of the frame, but is also prevented from tilting over in longitudinal direction. Referring particularly to FIG. 3, the carriage comprises a first foot and a second foot, one over each of the tracks 17. A pair of rollers 27–28, 29–30 is mounted at each end of foot 12. The rollers 27, 29 run on top of an L-shaped rail integral with the respective side of the frame base 10. The second rollers 28, 30 of each pair are disposed under the horizontal web of the L-profile, to prevent the displacement of the base 10 upwards from the rail 17, to prevent accidental tilting of the carriage over the rail in longitudinal direction. A pair of plain rollers 35, 36 run over the top of the beams 32 on the other side of the frame base 10.

Each foot supports an upright column 37, 38 welded to it and defining one side of a rectangular frame. The top of the frame is defined by a cross-beam 15. In the embodiment shown, the cross-beam is fixedly secured to the upright columns 37, 38 at a suitable elevation, it being understood that a vertically adjustable position of the cross-beam 15 can also be provided for if desired.

The cross beam houses a transverse guide screw 39 operated by a crank 40 at the column 37. The screw 39 threadably engages a slide block 41 which is slidable along the cross-beam 15 to a desired location across the frame base 10. The slide block is generally integral with a holder sleeve 42 (FIG. 3) which supports a chain saw support 43 adapted to secure a chain saw 44 to the carriage 26. The particular way of securement of the chain saw 44 to the mill is optional. In the embodiment shown, there are two holes drilled in the bar of the chain saw, for firm securement by bolts 45 to a U-shaped bracket 46. The described arrangement presents one of many possible embodiments of what can also be generally referred to as a chain saw holding device.

An handle 47 is welded to the carriage to facilitate the displacement of same along the frame base 10. Reference numeral 48 designates a safety frame directed to prevent accidental approach to the vicinity of the saw.

In operation, the frame is first assembled and the carriage (which may also be assembled in situ) is placed over the frame. With the saw 44 secured to the bracket 46, the device is ready to operate. The carriage 26 being rolled to one end of the frame base 10, a log 49 can easily be rolled onto the frame, preferably with wooden underpads to prevent contact of chain saw teeth with the frame while securing a complete cut through the diameter of the log. The log is rolled against the clamps 19. The turning of the screws 22 of the clamps results in the hooks 50 biting into the log to hold same ready to be cut. It will be noted from FIG. 2 that the carriage clears the clamp 19. Following a desired adjustment of transverse position of the saw by operating the crank 40, the device is ready to be pushed at push handle 47 along the frame base 10 into engagement with the clamped log. If the log is of an extreme length, the sectional design of the frame base 10 allows removal of one end subframe 11 and its placing under the log at the opposite end of the frame base 10, to allow continuation of the cutting, while the log is still held by at least two clamps 19. When the cut is finished, the resulting plank falls off sideways, allowing return of the carriage 26 back to the starting point (if necessary, with the requisite replacement of the frame section back to its starting position). Then, following adjustment of the transverse position of the saw by crank 40, the operation may be started again.

It will be appreciated that many modifications of the embodiment disclosed may exist without departing from the scope of the present invention. Accordingly, it is desired to protect by Letters Patent which may issue on this application all such embodiments as properly fall within the scope of our contribution to the art.

I claim:

1. A portable sawmill frame comprising, in combination:

(a) a plurality of rigid, rectangular frame-shaped base sections rigidly but releasably secured to each other in an end-to-end fashion, to thus define an elongated, rigid base which includes a pair of elongated guide rails, one at a first side of the base, the other at a second side of the base, said rails defining a normally generally horizontal plane;

(b) each base section having a first transverse end member and a second transverse end member, and a pair of straight, parallel, opposed, longitudinally extending guide rail sections comprised of a first guide rail section and a second guide-rail section; the first and second guide rail sections being parallel with each other and being spaced apart a predetermined distance in excess of a predetermined log width;

(c) said first and second guide rail sections, and thus the guide rails, defining each a straight, narrow, longitudinal, roller guide top surface and an undersurface portion adapted to rest on the ground when the base sections are assembled to form the base; the top surface and the undersurface being normally generally horizontal and being arranged at a vertical distance from each other of about two inches or less to allow rolling of a log aligned with the elongation of the rails transversely over said rail sections to an operative position in which the respective log is generally coextensive with the rails and is supported by the respective end members of the base sections;

(d) a carriage, comprising:

(i) rollers complementary with said rails to allow a movement of the carriage along the rails;

(ii) said rollers being mounted each at a lower end of a respective one of two upright members transversely spaced from each other a distance in excess of said predetermined log width;

(iii) said upright members having upper end portions rigidly secured to a cross-beam extending transversely of the carriage;

(e) a chain saw support slidable along said cross-beam and adapted to support a respective chain saw in a position with a saw bar thereof depending generally vertically downwardly from the cross-beam to a level disposed closely above a normally generally horizontal plane of coincidence of said end members, for cutting the respective log along a vertical cut extending in the direction of movement of said carriage along said rails;

(f) said support being provided with a displacement device for moving the support to a desired position along the cross-beam; and (g) a mounting device for securing to the base of the sawmill frame a pair of longitudinally spaced apart, normally generally upright columns of log clamping devices adapted to fixedly secure a respective log, resting on the end members, to the respective base section and thus to the sawmill frame.

2. The sawmill frame of claim 1, wherein the base comprises at least three said base sections rigidly but releasably connected to each other such that the rail sections on each side of the base define a straight extension of each other thus defining each a portion of the respective one of said rails.

3. The sawmill frame of claim 2, wherein said mounting device comprises a pair of mounting sleeves fixedly secured each to one of said base sections, each respective sleeve being located between the rail sections of the respective base section, being closely spaced from one of the respective rail sections and remote from the other one of the respective rail sections, each sleeve defining a generally vertical passage complementary with a lower part of a log clamp, each sleeve being provided with a tightening device for releasing but rigidly securing a vertical column of a respective log clamp to a respective sleeve and thus to the base at a location between the guide rails and adjacent to one of the rails, the spacing of the sleeve from said one of the rails being sufficient to allow the passage of the carriage over the log clamp placed in the sleeve.

4. The sawmill frame of claim 1, wherein said mounting device comprises a pair of mounting sleeves fixedly secured each to one of said base sections, each respective sleeve being located between the rail sections of the respective base section, being closely spaced from one of the respective rail sections and remote from the other one of the respective rail sections, each sleeve defining a generally vertical passage complementary with a lower part of a log clamp, each sleeve being provided with a tightening device for releasably but rigidly securing a vertical column of a respective log clamp to a respective sleeve and thus to the base at a location between the guide rails and adjacent to one of the rails, the spacing of the sleeve from said one of the rails being sufficient to allow the passage of the carriage over the log clamp placed in the sleeve.

* * * * *

UNITED STATES PATENT AND TRADEMARK OFFICE

CERTIFICATE OF CORRECTION

PATENT NO. : 5,243,892

DATED : Sep. 14, 1993

INVENTOR(S) : Josef Jindra

It is certified that error appears in the above-identified patent and that said Letters Patent is hereby corrected as shown below:

On the title page, left column, after line [22], insert the following:

[30] Foreign Application Priority Data
Mar. 25, 1991 [SE] Sweden.....9100881-3

Signed and Sealed this

Nineteenth Day of April, 1994

Bruce Lehman

*Attest:*

BRUCE LEHMAN

*Attesting Officer*

*Commissioner of Patents and Trademarks*